United States Patent [19]

Helms

[11] 4,265,255

[45] May 5, 1981

[54] METHOD AND MACHINE FOR PROCESSING WEBS OF CIGARETTE PAPER OR THE LIKE

[75] Inventor: Adolf Helms, Hamburg, Fed. Rep. of Germany

[73] Assignee: Hauni-Werke Körber & Co. KG, Hamburg, Fed. Rep. of Germany

[21] Appl. No.: 28,320

[22] Filed: Apr. 9, 1979

[30] Foreign Application Priority Data

Apr. 14, 1978 [DE] Fed. Rep. of Germany ..... 2816165

[51] Int. Cl.[3] ..... A24C 5/24; A24C 5/47

[52] U.S. Cl. ..... 131/69; 131/94

[58] Field of Search ..... 131/69, 34, 35, 37, 131/90, 94, 20 R; 156/215, 475, 320, 322

[56] References Cited

U.S. PATENT DOCUMENTS

| | | | |
|---|---|---|---|
| 2,543,229 | 2/1951 | Chapman | 156/334 X |
| 2,991,753 | 7/1961 | Dearsley | 131/37 X |
| 3,420,243 | 1/1969 | McArthur | 131/94 |
| 3,527,234 | 9/1970 | Hinzmann | 131/94 |
| 3,746,606 | 7/1973 | Chao | 156/334 X |
| 3,815,612 | 6/1974 | Molins | 131/94 |
| 3,933,159 | 1/1976 | Molins | 131/94 |
| 4,175,996 | 11/1979 | Battard et al. | 131/69 X |

*Primary Examiner*—Stephen C. Pellegrino
*Attorney, Agent, or Firm*—Peter K. Kontler

[57] ABSTRACT

A web of cigarette paper, imitation cork or similar sheet-like material which is used as a tubular wrapper for rod-like fillers of tobacco or filter material or which is subdivided into discrete uniting bands for plain cigarettes and filter plugs is coated with one or more layers of an aqueous dispersion of hotmelt. The layer or layers are thereupon heated to expel water therefrom before the web is draped around one or more rod-shaped smokers' products. The layer or layers are thereupon heated to a temperature at which the dried hotmelt melts, either before or during and/or subsequent to draping, to activate the hotmelt. If the web is converted into uniting bands prior to draping around groups of coaxial rod-shaped articles, and if the filter plugs of filter cigarettes are to be provided with holes for admission of atmospheric air into the column of tobacco smoke, the web is provided with two spaced-apart layers of aqueous dispersion of hotmelt prior to subdivision into uniting bands and the holes for admission of atmospheric air are formed in the two layers subsequent to expulsion of liquid.

24 Claims, 4 Drawing Figures

Fig.1
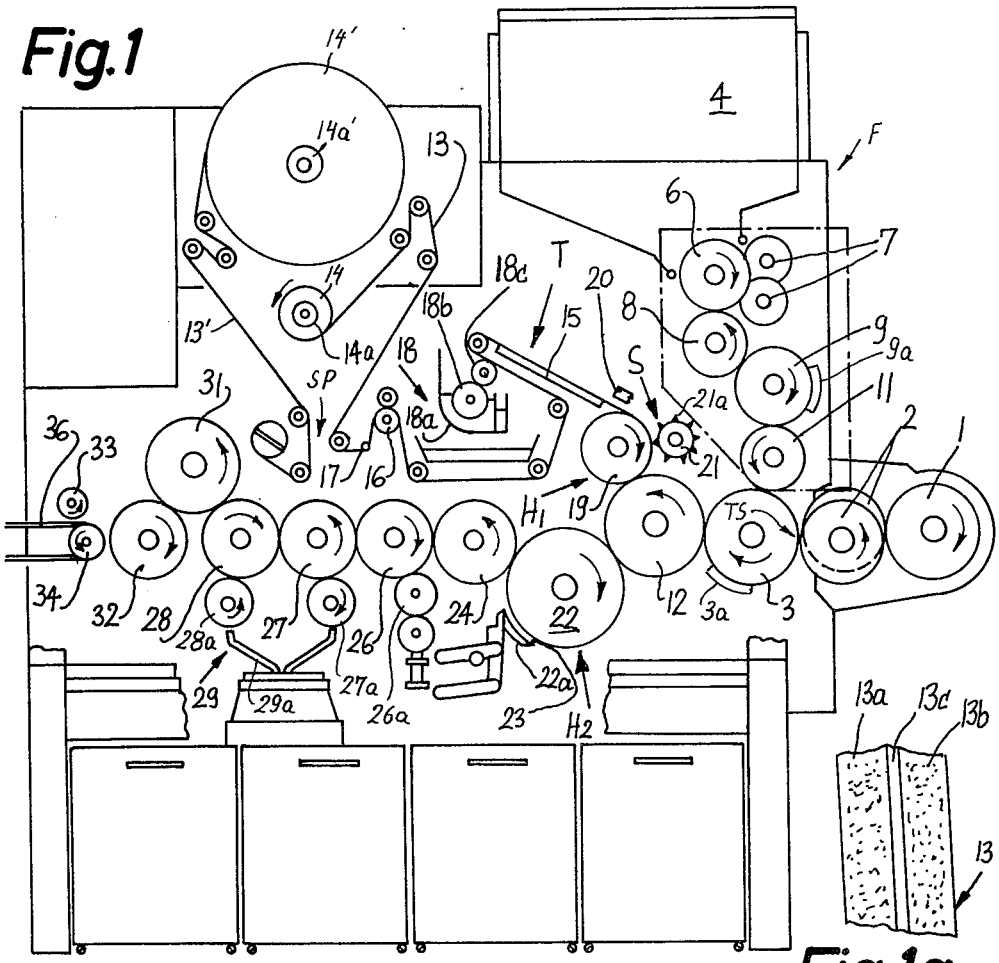
Fig.1a
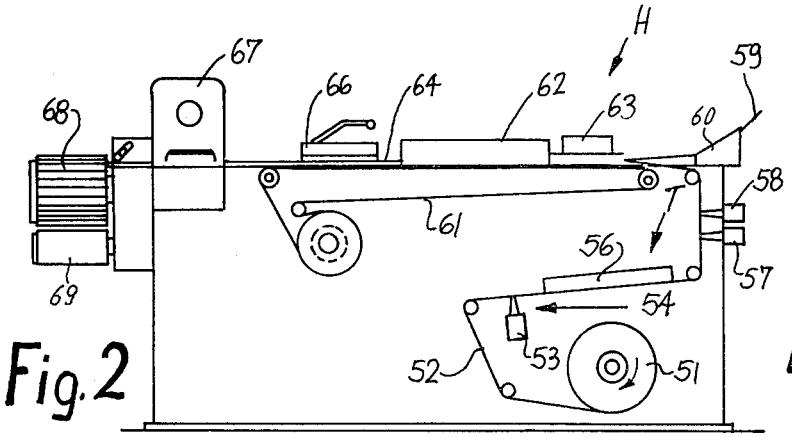
Fig.2
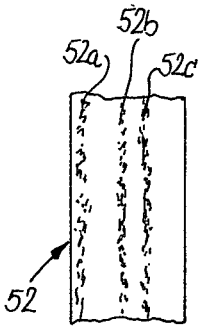
Fig.2a

METHOD AND MACHINE FOR PROCESSING WEBS OF CIGARETTE PAPER OR THE LIKE

BACKGROUND OF THE INVENTION

The invention relates to a method and machine for connecting a sheet-like wrapping material (e.g., a continuous web of cigarette paper or portions of such web) with rod-shaped smokers' products including fillers of tobacco or filter material, filter mouthpieces, plain cigarettes, groups of coaxial or parallel cigarettes or the like. More particularly, the invention relates to a method and machine for connecting a sheet-like wrapping material with rod-shaped smokers' products by means of a hotmelt, i.e., an adhesive which (in contrast to the so-called wet adhesives) is activated in response to heating and sets in response to cooling.

It is already known to apply an aqueous dispersion of polyvinyl acetate glue to a web of cigarette paper or similar sheet-like material which is used as a wrapper for tobacco fillers and/or fillers consisting of fibrous or other filter material and/or as a means for uniting filter rod sections with plain cigarettes, cigars or cigarillos. If the dispersion is applied to a continuous web of cigarette paper, it normally forms a layer along one marginal portion of the web. The web is thereupon draped around a rod-like filler of tobacco or filter material so that the adhesive-coated marginal portion overlies the other marginal portion of the resulting tubular wrapper, i.e., the overlapping marginal portions form a seam which extends in parallelism with the axis of the wrapped filler and is heated to expel water from the adhesive layer and thereby to insure the establishment of a reliable bond in response to activation and subsequent setting of hotmelt.

In a modern mass-producing cigarette maker or filter rod maker, the web of wrapping material is transported at a very high speed (normally in the range of 400–500 meters per minute). Therefore, the interval of time which is available for expulsion of water from an aqueous dispersion of hotmelt is extremely short. In other words, if the temperature at which the dispersion is heated to expel water from the applied adhesive coat is relatively low, the interval of time for expulsion of water is too long except if the dimensions of the machine are increased for the express purpose of allotting the necessary time for drying of the seam. Alternatively, it is necessary to increase greatly the temperature in the region where the coat of diluted hotmelt is subjected to a drying action. This is undesirable for a number of reasons, especially when the machine is brought to a standstill, because the wrapping material is likely to be charred or to go up in flames unless the machine is equipped with complex, costly and highly sensitive heat sensing devices.

The situation is analogous in certain packing machines for arrays of plain or filter tipped rod-shaped smokers' products wherein such arrays are confined in packets consisting of one or more suitably deformed blanks made of paper, cardboard, metallic foil or synthetic plastic material. Portions of certain blanks must be bonded to each other by one or more layers of adhesive.

OBJECTS AND SUMMARY OF THE INVENTION

An object of the invention is to provide a novel and improved method of treating an aqueous dispersion of hotmelt which is used as an adhesive on cigarette paper, imitation cork or analogous sheet-like wrapping material for rod-shaped smokers' products.

Another object of the invention is to provide a novel and improved method of treating aqueous dispersions of hotmelt in a small area and without danger of damaging or destroying the wrapping material as a result of excessive or prolonged heating.

A further object of the invention is to provide a method which insures adequate treatment of aqueous dispersions of hotmelt in machines for mass-production of rod-shaped smokers' products including plain or filter tipped cigarettes, cigars, cigarillos and/or filter rod sections.

An additional object of the invention is to provide a method which insures adequate treatment of aqueous dispersions of hotmelt in conventional machines for the making of filter rod sections, plain cigarettes, filter cigarettes or analogous rod-shaped articles which constitute or form part of finished smokers' products.

Another object of the invention is to provide a machine for the making of finished rod-shaped smokers' products or rod-shaped constituents of such products wherein sheet-like wrapping material is coated with an aqueous dispersion of hotmelt and such aqueous dispersion is treated in a novel and improved way.

A further object of the invention is to provide a cigarette making, filter tipping or filter rod making machine with novel and improved means for treating the adhesive which is used to connect the wrapping material with one or more rod-like smokers' products.

An ancillary object of the invention is to provide the machine with novel and improved means for treating an aqueous dispersion of hotmelt prior and/or during setting of such adhesive.

A further object of the invention is to provide the machine with novel and improved means for completing the preliminary and final treatments of an aqueous dispersion of hotmelt in a small area and while the machine is operated at normal speed or at a reduced speed (including stoppage).

An additional object of the invention is to provide the machine with novel and improved means for expelling water from aqueous dispersions of hotmelt, with novel and improved means for activating the dehydrated hotmelt, and with novel and improved means for causing the dehydrated hotmelt to set.

A further object of the invention is to provide rod-shaped smokers' products wherein the wrappers are provided with one or more layers of hotmelt which is treated in accordance with the above outlined method.

One feature of the invention resides in the provision of a method of connecting a sheet-like wrapping material with rod-shaped smokers' products. The method comprises the steps of applying to one side of the wrapping material at least one layer of an aqueous dispersion of hotmelt (e.g., a copolymer of ethylene vinyl acetate which is applied in such quantities that the layer has a thickness of between 10 and 15 micrometers, preferably approximately 12 micrometers), thereupon expelling liquid (e.g., water) from the layer including heating the layer (such heating may involve contacting the other side of the wrapping material with a heated surface and/or radiation heating the layer), and the additional steps of heating the thus dried or dehydrated layer to a temperature at which the hotmelt of the layer is in a molten state (i.e., at least to the melting point of hotmelt) and draping the wrapping material around smokers' (the heating step can precede the draping step, it may be carried out simultaneously with the draping step, or at least one stage of the heating step may precede and at least one stage of the heating step may take place simultaneously with the draping step).

The wrapping material can form a continuous web, and the method then preferably comprises the additional steps of transporting the continuous web lengthwise in the course of the applying and expelling steps and subdividing the leader of the web into a succession of discrete uniting bands upon completion of the expelling step. The step of heating the dried layer then includes heating the uniting bands and the draping step includes draping or convoluting each uniting band around a discrete smokers' product. Each such discrete smokers' product may comprise several coaxial rod-shaped articles (e.g., two plain cigarettes of unit length and a filter plug of double unit length between the plain cigarettes), and the draping step then preferably includes rolling the respective rod-shaped products about their axes to thereby convolute the corresponding uniting bands therearound while the products are located in a gap whose width does not exceed and is preferably slightly less than the diameter of a product. When the web is subdivided into discrete uniting bands, the applying step may comprise providing the one side of the web with two discrete layers of aqueous dispersion. Such layers are preferably adjacent to the marginal zones of the one side of the web and flank an uncoated web portion whose width is preferably constant and which is preferably parallel to the marginal portions of the web.

If the smokers' product is a continuous rod (e.g., a rod-like filler of tobacco or filamentary filter material) and the wrapping material is a continuous web of cigarette paper, imitation cork or the like, the method preferably further comprises the step of transporting the rod and the web lengthwise. The heating step then preferably precedes the draping step, i.e., the dried hotmelt is tacky at the time when the web is draped around the rod to form a continuous tubular wrapper whose marginal portions overlap and adhere to each other. In accordance with the just described embodiment of the method, the applying step may including providing a single layer of aqueous dispersion along one marginal portion of one side of the web, namely, along that marginal portion which overlies the other marginal portion upon completion of the draping step so that the overlapping marginal portions form a seam extending in parallelism with the axis of the wrapped rod.

The method may further comprise the step of forcibly cooling the layer or layers upon completion of the additional steps. The term "forcibly cooling" is intended to denote cooling with streams or jets of cold gaseous fluid, by contact with a cooled surface (e.g., a surface which is indirectly cooled by a circulating liquid or gaseous coolant) or a combination of such or analogous cooling actions.

When the layer or layers are dehydrated, their thickness is preferably a small fraction (e.g., one-half) of the thickness of the layer or layers of aqueous dispersion.

The expression "aqueous dispersion of hotmelt" is intended to denote a flowable body consisting of finely distributed hotmelt in an evaporable liquid carrier medium which may but need not consist of or contain $H_2O$. A presently preferred hotmelt is a copolymer of ethylene vinyl acetate because an aqueous dispersion of such hotmelt can form an extremely thin layer (i.e., within the aforementioned range of 10–15 and preferably approximately 12 micrometers). This is highly desirable because the quantity of liquid carrier medium which must be expelled from such thin layer or layers is very small, i.e., the drying or liquid expelling step can be completed within a short interval of time and without resorting to high temperatures.

Forcible cooling of activated hotmelt in order to achieve rapid setting is especially desirable in modern high-speed cigarette or filter rod making machines wherein the tubular wrapper which surrounds a filler of tobacco or fibrous and/or other filter material is subjected to highly pronounced stresses applied by the compressed filler which tends to expand radially and thereby to open the seam. Moreover, rapid cooling is desirable if the station where the wrapping material is draped around the filler is very close to the station where the resulting wrapped filler is severed to yield a succession of filter rod sections or plain cigarettes, cigars or cigarillos. The same holds true when the web is subdivided into uniting bands which serve to connect pairs of plain cigarettes with filter plugs of double unit length and wherein the mechanism for subdividing the resulting filter cigarettes of double unit length into pairs of filter cigarettes of unit length is close or immediately adjacent to the draping station where the uniting bands are convoluted around the filter plugs and around the adjacent inner end portions of the respective plain cigarettes.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a schematic front elevational view of a filter tipping machine wherein the wrapping material is a continuous web of cigarette paper or imitation cork and is coated, dried, severed, heated and draped in accordance with the invention;

FIG. 1*a* illustrates a portion of the coated side of the web in the machine of FIG. 1;

FIG. 2 is a side elevational view of a portion of a filter rod making machine wherein a continuous web of wrapping material is coated, dried, heated and draped in accordance with the invention; and FIG. 2*a* shows a portion of the coated side of the web in the machine of FIG. 2.

DESCRIPTION OF THE PREFERRED EMBODIMENTS

FIG. 1 shows a filter tipping machine of the type known as MAX S (produced by the assignee of the present application). The machine is directly coupled to a cigarette maker (e.g., to a machine known as GARANT produced by the assignee of the present application). The link between the maker and the filter tipping machine is a rotary drum-shaped row forming conveyor 1 which has peripheral flutes receiving plain cigarettes of unit length from the outlet of the cigarette maker. Plain cigarettes which enter the flutes of the conveyor 1 form two rows which are respectively located in the evenly and oddly numbered flutes. The cigarettes of one row are nearer to one axial end and the cigarettes of the other row are nearer to the other axial end of the conveyor 1. The latter transports the two rows of cigarettes sideways and admits the cigarettes of one row into successive flutes of a first rotary drum-shaped aligning conveyor 2. The cigarettes of the other row are transferred into successive flutes of a second rotary drum-shaped aligning conveyor 2. The conveyors 2 are driven at different speeds and/or transport the plain cigarettes of the respective rows through different distances so that successive cigarettes of one row enter successive flutes of a rotary drum-shaped assembly conveyor 3 simultaneously with successive cigarettes of the other row. The cigarettes which enter a flute of the assembly conveyor 3 are coaxial to each other but are spaced apart by a distance which at least equals the length of a filter plug of double unit length.

The frame F of the filter tipping machine further supports a magazine 4 for a stack of filter rod sections of six times unit length. The outlet of the magazine 4 is adjacent to a rotary drum-shaped severing conveyor 6 which has peripheral flutes each of which withdraws from the magazine 4 a filter rod section of six times unit length. Such sections are transported clockwise, as viewed in FIG. 1, past two rotary disk-shaped knives 7 which subdivide each section into three portions or plugs of double unit length. The sets of three coaxial plugs each are transferred into the peripheral flutes of three rotary disk-shaped components of a staggering conveyor 8 whereon the plugs of each set are shifted as considered in the circumferential direction of the conveyor 8, prior to being transferred into successive peripheral flutes of a rotary drum-shaped shuffling conveyor 9. The latter cooperates with stationary cams 9*a* to move some or all of the plugs axially so that the shuffled plugs form a single row wherein each preceding plug is in exact register with the next-following plug. Successive plugs of the thus obtained row are transferred into successive peripheral flutes of a rotary drum-shaped accelerating conveyor 11 which delivers successive plugs into successive flutes of the assembly conveyor 3 in such a way that each freshly transferred plug occupies the space between the spaces reserved for the pairs of plain cigarettes which are delivered by the aligning conveyors 2. Thus, each flute of the assembly conveyor 3 which has advanced beyond the transfer station TS between the conveyor 3 on the one hand and the aligning conveyors 2 on the other hand contains a group of three coaxial rod-shaped articles including a pair of coaxial but spaced apart plain cigarettes of unit length and a filter plug of double unit length therebetween. Such groups thereupon advance between two stationary cams 3*a* which shift one or both plain cigarettes of each group axially so that each of the resulting condensed groups contains a centrally located filter plug and two plain cigarettes whose inner end portions abut against the respective end faces of the aligned filter plug.

The condensed groups of rod-shaped articles are delivered into successive flutes of a rotary drum-shaped transfer conveyor 12 which cooperates with a rotary suction drum 19. The peripheral surface of the drum 19 is formed with suction ports which attract uniting bands during transport of such bands toward the transfer station between the drum 19 and the transfer conveyor 12. The uniting bands are obtained by subdividing a web 13 of cigarette paper, imitation cork or other suitable wrapping material. The web 13 is withdrawn from a bobbin 14 which is mounted on a spindle 14*a*. On its way from the bobbin 14 toward the periphery of the suction drum 19, the web 13 advances past a so-called curling device 17 which eliminates eventual localized stresses in the web. A suitable curling device is disclosed in commonly owned U.S. Pat. No. 3,962,957 granted June 15, 1976 to Alfred Hinzmann. The web 13 thereupon advances past a paster 18 comprising a tank 18*a* for a supply of an aqueous dispersion of hotmelt, a withdrawing wheel 18*b* which dips into the supply of adhesive in the tank 18*a* so that its peripheral surface withdraws a continuous film of liquid adhesive, and a roller-shaped applicator 18*c* which transfers the film of adhesive from the periphery of the wheel 18*b* to the underside of the adjacent portion of the running web 13. On its way from the curling device 17 whose sharp edge engages and flexes successive increments of the web 13, the latter advances through the nip of two transporting rolls 16 which draw the web off the bobbin 14.

As shown in FIG. 1*a*, the configuration of the periphery of the applicator 18*c* is such that the latter transfers to the adjacent side of the web 13 two relatively wide strips or layers 13*a* and 13*b* of liquid adhesive. Such layers are separated from each other by a centrally located uncoated portion 13*c*. Each of the layers 13*a*, 13*b* extends all the way to the respective margin of the web 13. The width of the layers 13*a* and 13*b* is constant, i.e., the width of the uncoated portion or strip 13*c* is also constant as long as the width of the web 13 matches a desired value. The liquid adhesive in the tank 18*a* of the paster 18 is an aqueous dispersion of a copolymer of ethylene vinyl acetate. The layers of liquid adhesive which are applied to the marginal portions of the web 13 are preferably thin, e.g., their thickness is in the range of 10–15 micrometers, preferably approximately 12 micrometers. When the liquid adhesive sets, its thickness is approximately one-half the thickness of the liquid layers (i.e., in the range of approximately 6 micrometers).

Prior to reaching the periphery of the suction drum 19, successive portions of the adhesive-coated web 13 advance past a drying or liquid expelling station T which comprises a heating device 15 (e.g., an infrared heater) placed into immediate or close proximity of the adjacent portion of the path for the web 13. The heating device 15 causes evaporation of liquid from the layers 13*a*, 13*b* so that the web portion which approaches the suction drum 19 carries two dried layers of adhesive. The heating action of the device 15 is especially pronounced if the uncoated side of the web 13 slides therealong during travel through the drying station T. In such instances, the heating device may constitute a heated rail which contacts the web at the station T. The length of the heating device 15 is selected in such a way that, when the web 13 is transported at normal speed, evaporation of liquid from the wet layers 13*a*, 13*b* is completed before the dried portion of the web 13 reaches the drum 19.

The drum 19 forms part of a severing unit S which further includes a roller 21 carrying a set of knives 21*a* which sever the leader of the web 13 at regular intervals so that the web yields a succession of uniting bands each carrying (at one of its sides) two dried layers of hotmelt adhesive. The suction drum 19 of the severing device S is heated to a predetermined temperature (e.g., to approximately 160° C. if the hotmelt melts at a temperature of 70° C.) and thus constitutes the first stage H1 of a heating unit. The stage H1 effects partial heating of dried adhesive layers 13*a*, 13*b*, preferably to a temperature which at least matches the melting point (70° C.). This insures that the dried and heated strips 13*a*, 13*b* become viscous and adhere to successive groups of rod-shaped articles in the oncoming flutes of the transfer conveyor 12. Each uniting band is applied to the respective group in such a way that it contacts the corresponding filter plug of double unit length as well as the adjacent inner end portions of the associated plain cigarettes of unit length. The transfer conveyor 12 delivers successive groups (each of which carries a uniting band) onto the periphery of a rotary drum-shaped draping conveyor 22 cooperating with a stationary or mobile draping device 22*a* to convert each uniting band into a tube which surrounds the corresponding filter plug as well as the adjacent end portions of the aligned plain cigarettes, i.e., each such group is converted into a filter cigarette of double unit length. The draping conveyor 22 is also heated (e.g., to a temperature of approximately 60° C. if the hotmelt on the uniting bands melts at a temperature of approximately 70° C.). Thus, the conveyor 22 can be said to constitute the second stage H2 of the heating unit.

The uniting bands are converted into the aforementioned tubes during travel through a gap or clearance 23 between the preferably stationary draping device 22*a* and the conveyor 22. The device 22*a* is also heated (e.g., to a temperature of approximately 210° C. if the hotmelt on the uniting bands melts at 70° C.). The manner in which the device 22*a* cooperates with the conveyor 22 to convert successive uniting bands into tubes which sealingly connect the respective filter plugs to the aligned plain cigarettes is disclosed, for example, in commonly owned U.S. Pat. No. 3,527,234 granted Sept. 8, 1970 to Alfred Hinzmann.

Finished filter cigarettes of double unit length are transferred into successive flutes of a rotary drum-shaped cooling conveyor 24 which delivers successive filter cigarettes of double unit length into the flutes of a rotary drum-shaped severing conveyor 26 cooperating with a rotary disk-shaped knife 26*a* to subdivide each filter cigarette of double unit length into two filter cigarettes of unit length. The knife 26*a* severs the strip-shaped portions 13*c* of successive tubes, i.e., those portions of convoluted uniting bands which are not coated with hotmelt. This insures that the knife 26*a* is not contaminated with adhesive. The cooling conveyor 24 can constitute a hollow drum-shaped body and may be associated with means for circulating a liquid or gaseous coolant through its interior. The main purpose of the conveyor 24 is to insure rapid setting of those portions of successive tubes which overlap each other, i.e., which form seams extending in the axial direction of the respective filter cigarettes of double unit length and which are most likely to open due to tendency (or eventual tendency) of convoluted uniting bands to reassume their flat or substantially flat shape. It is preferred to transfer successive filter cigarettes of double unit length from the draping conveyor 22 onto the cooling conveyor 24 in such a way that the aforementioned seams of the tubes enter the flutes of the conveyor 24 and are thus in direct contact with the cooled surfaces surrounding the respective flutes.

The severing conveyor 26 delivers pairs of coaxial filter cigarettes of unit length (hereinafter called cigarettes for short) into successive flutes of a rotary drum-shaped conveyor 27 forming part of a turn-around device 29 of the type disclosed in commonly owned U.S. Pat. No. 3,583,546 granted June 8, 1971 to Gerhard Koop. The turn-around device 29 further comprises a second rotary drum-shaped conveyor 27*a* which has peripheral flutes receiving one cigarette of each pair of cigarettes in the flutes of the conveyor 27. The conveyor 27 delivers the non-removed cigarettes into alternate flutes of a third rotary drum-shaped conveyor 28 of the turn-around device 29. The cigarettes which are delivered by the flutes of the conveyor 27*a* are attracted to the upper portions of orbiting arms 29*a* which transport the respective cigarettes along an arc of 180 degrees and insert the inverted cigarettes into the oncoming flutes of a further rotary drum-shaped conveyor 28*a* of the device 29. The conveyor 28*a* delivers the inverted cigarettes into the empty flutes of the conveyor 28 so that each flute of this conveyor contains a cigarette and the filter tips of all cigarettes face in the same direction. Such cigarettes preferably form a row wherein each preceding cigarette is in accurate register with the next-following cigarette.

Successive cigarettes on the conveyor 28 are transferred onto a rotary drum-shaped testing conveyor 31 whereon the wrappers of the cigarettes are tested for the presence or absence of leaks, open seams, frayed ends and/or other defects. Successive tested cigarettes are transferred onto an ejecting conveyor 32 which cooperates with a pneumatic ejector nozzle (not shown) serving to segregate defective cigarettes from satisfactory cigarettes in a manner well known from the art of cigarette testing, and the satisfactory cigarettes are transferred onto the upper reach of a belt conveyor 36 which delivers satisfactory cigarettes to storage or directly into the magazine of a packer, not shown. If desired, the conveyor 32 may form part of a device which tests the tobacco-containing ends or heads of cigarettes for density and the cigarettes having defective heads can be ejected at the same station where the aforementioned ejecting nozzle segregates cigarettes having defective wrappers. The belt conveyor 36 is trained over pulleys or rollers 34 one of which is shown in FIG. 1. The illustrated roller or pulley 34 cooperates with a braking drum 33 for satisfactory cigarettes.

The filter tipping machine of FIG. 1 is preferably provided with a sensor (not shown) which detects the absence of movement of the web 13 in the region of the heating device 15 and/or suction drum 19 to turn off the heating unit (H1+H2) and the drying means (device 15) when the web is idle. This prevents charring of or other heat-induced damage to the web 13 prior to conversion into discrete uniting bands. It is also possible to use the sensor as a means for initiating automatic ejection of groups of rod-shaped articles and of filter cigarettes of double unit length in the stage H2 (i.e., on the conveyor 22) of the heating unit.

FIG. 1 further shows a fresh reel or bobbin 14' on a spindle 14*a'*. The bobbin 14' contains a fresh web 13' whose leader is located at a splicing station SP. When the supply of running web 13 is nearly exhausted, a mechanism at the station SP automatically attaches the leader of the fresh web 13' to the web 13 and the resulting splice is trimmed by severing the web 13 behind and the web 13' ahead of the joint. A mechanism which can be used at the splicing station SP is disclosed, for example, in commonly owned U.S. Pat. No. 3,730,811 granted May 1, 1973 to Hans-Joachim Wendt.

In the manufacture of cigarettes with so-called climatic zones, it is desirable to perforate the web 13 by resorting to perforating units having means for effecting spark discharge, needles, one or more laser beams or other suitable piercing or material removing means. The resulting perforations or holes admit cool atmospheric air into the column of tobacco smoke when the cigarettes are lighted. The prerequisite for admission of air into the column of tobacco smoke is that the wrappers of filter plugs and filter rod sections (i.e., of articles which are being withdrawn from the magazine 4) be permeable to air. This is the case with certain types of filter plugs. The making of holes in the webs which are converted into uniting bands and tubes in accordance with heretofore known procedures is not desirable because the adhesive (if applied downstream of the perforating station) fills the holes and thus prevents predictable entry of desired quantities of air into the filter tips of filter cigarettes. The making of holes in a web which is already coated with adhesive and while the adhesive is still wet is equally unsatisfactory because the adhesive not only is likely to flow into the holes but also contaminates the needles or analogous mechanical perforating or piercing instrumentalities.

In accordance with another feature of the present invention, the filter tipping machine comprises a perforating unit 20 which is adjacent to the downstream end of the drying station T so that the perforating unit can make holes or perforations in dried adhesive, i.e., in the strips 13*a*, 13*b* which consist of layers of dehydrated hotmelt. A perforating unit which can be used in the filter tipping machine of FIG. 1 is disclosed in commonly owned U.S. Pat. No. 4,090,826 granted May 23, 1978 to Alfred Hinzmann. Other suitable perforating units are disclosed in commonly owned patent application Ser. No. 841,108 filed Oct. 11, 1977 by Günter Wahle et al. and in commonly owned patent application Ser. No. 864,441 filed Dec. 27, 1977 by Elke Lüders et al. The disclosures of the just mentioned patent to Hinzmann and of the applications to Wahle et al. and Lüders et al. are incorporated herein by reference.

FIG. 2 shows a portion of a filter rod making machine which is similar to that known as KDF II produced and sold by the assignee of the present application. The machine of FIG. 2 can produce filter rod sections for delivery into the magazine 4 of the filter tipping machine of FIG. 1. The manner in which a tow 59 of filamentary filter material (such as cellulose acetate) is processed prior to entering a so-called gathering horn 60 is disclosed, for example, in commonly owned U.S. Pat. No. 3,741,846 granted June 26, 1973 to Heinz Greve. The horn 60 serves to convert a relatively wide layer of fibers (which are normally sprayed with atomized plasticizer, such as triacetin) into a rod-like filler, and the rod-like filler enters a wrapping mechanism 62 which drapes the filler into a continuous web 52 of cigarette paper, imitation cork or other suitable sheet-like wrapping material. The web 52 is withdrawn from a bobbin 51 or another suitable source of wrapping material and is conveyed past a paster 54 which coats one side of the running web with an aqueous dispersion of a hotmelt in a manner as shown in the left-hand portion of FIG. 2*a*. The marginal layer 52*a* of aqueous dispersion of hotmelt is applied by a nozzle 53 of the paster 54. The thus coated web 52 thereupon advances through a drying station T including a heating device 56, e.g., a heated rail along which the uncoated side of the web 52 slides on its way toward the wrapping mechanism 62. The device 56 expels liquid from the aqueous dispersion of hotmelt (such hotmelt may be identical with that which is used in the tank 18*a* of the paster 18 shown in FIG. 1). Thus, the layer 52*a* is dried not later than when it advances beyond the drying station T. The web 52 then advances along two additional nozzles 57 and 58 which apply adhesive strips or layers 52*b* and 52*c* shown in FIG. 2*a*. The adhesive which is discharged by the nozzles 57 and 58 may be a wet adhesive, i.e., an adhesive which sets in response to heating.

Successive increments of the running web 52 meet successive increments of the rod-like filler of filter material on the upper reach of an endless belt conveyor 61 known as garniture. The garniture 61 draws the web 52 off the bobbin 51 and transports the web and the filler through a heating or activating unit H comprising a heating device 63 for the layer 52*a*. The web 52 thereupon enters the draping mechanism 62 and is wrapped around the filler so that it forms a tubular wrapper whose marginal portions overlie each other (i.e., the marginal portion which carries the layer 52*a* of dried and heat-activated hotmelt overlaps the other marginal portion) to form a seam which extends in parallelism with the axis of the resulting wrapped rod-like filler 64. The seam is forcibly cooled during travel past a cooling device 66 and the wrapped rod-like filler is severed at regular intervals by one or more orbiting knives of a conventional cutoff 67 so that it yields a file of discrete filter rod sections of desired length, e.g., six times unit length. Successive sections are propelled into successive flutes of a rotary drum-shaped row forming conveyor 68 which delivers one or more rows of sections (the sections of such row or rows move sideways) onto the upper reach of a belt conveyor 69 which delivers the sections into the magazine 4 of the filter tipping machine of FIG. 1 or to a conventional pneumatic sender which propels the sections to the magazine or magazines of one or more filter tipping machines.

The strips or layers 52*b* and 52*c* serve to bond the wrapper (converted web 52) to the adjacent portions of the rod-like filler.

If the aqueous dispersion of hotmelt issuing from the nozzle 53 is identical with that which is stored in the tank 18*a* of FIG. 1, the heating device 56 heats the layer 52*a* to the same extent as the heating device 15 of FIG. 1. Analogously, the device 63 heats the dried layer 52*a* to a temperature which at least matches the melting point of dried hotmelt. The cooling action of the device 66 suffices to insure that the wrapper of the filler 64 does not open on its way toward or in the cutoff 67. As a rule, the horn 60 and the mechanism 62 compress the filler so that the material of the confined filler tends to expand radially and to open the seam which is formed by the overlapping marginal portions of the draped web 52. Details of a filter rod making machine which is provided with means for heating and cooling the wrapper are disclosed, for example, in commonly owned British Pat. Nos. 1,282,173 and 1,378,169.

The mode of operation of the filter rod making machine of FIG. 2 is similar to that of a cigarette maker, e.g., the aforementioned GARANT machine. The main difference is that, in a GARANT, the gathering horn 60 is omitted and the filler which is draped into the web consists of tobacco particles. Thus, the method of the present invention can be used with equal advantage in connection with the production of plain cigarettes, cigarillos or cigars.

It is further possible to resort to the improved method in connection with the packing of arrays of cigarettes, cigars or cigarillos. A packing machine comprises means for draping arrays of smokers' products (e.g., each such array may consist of twenty parallel plain or filter cigarettes) into one or more blanks consisting of paper, cardboard, metallic foil and/or synthetic plastic material (e.g., cellophane). The blanks can be obtained by severing a continuous web of wrapping material at regular intervals, e.g., in a manner as described in connection with severing of the web 13 by the unit S of FIG. 1. The thus obtained blanks often carry coats of adhesive so that portions thereof can be bonded to each other in order to form inner, outer or intermediate envelopes of packets for cigarettes or the like. The manner in which such continuous webs are coated with an aqueous dispersion of hotmelt is or can be the same as or similar to that described in connection with the treatment of the web 13 in the machine of FIG. 1.

Still further, the machine of FIG. 2 can be replaced with a machine wherein several prefabricated filter rod sections are placed end-to-end and converted into composite fillers which are thereupon draped into cigarette paper or other suitable sheet-like wrapping material and subdivided into so-called multiplex filter plugs. For example, a multiplex filter plug may contain a rod-shaped portion of cellulose acetate fibers, a rod-shaped portion of charcoal granulae and/or a rod-shaped portion consisting of fibrous filter material which is interspersed with granulae of charcoal or the like. Reference may be had to commonly owned U.S. Pat. No. 4,043,454 granted Aug. 23, 1977 to Joachim Reuland.

An important advantage of the improved method and machine is that the heat-activatable adhesive need not be applied in activated condition, i.e., that the heating of adhesive can take place subsequent to application to one side of the running web. The application of activated (molten) hotmelt presents many problems. As a rule, a paster which applies activated (heated) hotmelt is complex, bulky and expensive. Therefore, many presently known machines for the making and/or processing of rod-shaped articles which constitute or form part of smokers' products still employ a wet adhesive in spite of the fact that hotmelt is a more desirable adhesive.

Another important advantage of the improved method and machine is that the treatment of applied hotmelt takes place in at least two steps, namely, during transport through the drying station and during transport through the (single-stage or multi-stage) heating unit. The drying station can be provided at a locus where the corresponding heating device (15 or 56) is in long-lasting contact with the web (13 or 52) without necessitating a slowdown of transport of the web and/or an increase of the dimensions of the machine. The dried hotmelt is thereupon rapidly heated to or above the melting point during travel through a relatively short heating unit. The interval of travel of the web through the drying station is relatively short because the layer or layers of aqueous dispersion of hotmelt are very thin, and the interval of travel of the web or uniting bands through the heating unit is even shorter because the dried hotmelt can be rapidly heated to or above the melting point. As described in connection with FIGS. 1 and 2, the longer-lasting drying or liquid-expelling step is preferably carried out in that portion of the respective machine wherein the wrapping material is in the form of a continuous web because such portion of the machine invariably provides ample room for installation of relatively long drying devices.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. A method of connecting a sheet-like wrapping material with rod-shaped smokers' products, comprising the steps of applying to one side of the wrapping material at least one layer of an aqueous dispersion of hotmelt; thereupon expelling the liquid from the layer, including heating the layer; and the additional steps of heating the layer to a temperature at which the hotmelt of the layer is in a molten state, and draping the wrapping material around smokers' products.

2. The method of claim 1, wherein the wrapping material constitutes a continuous web and further comprising the steps of transporting the web lengthwise in the course of said applying and expelling steps and subdividing the web into discrete uniting bands upon completion of said expelling step, said additional step of heating the dried layer including heating the uniting bands and said draping step including draping each uniting band around a discrete smokers' product.

3. The method of claim 2, wherein each of said discrete smokers' products comprises several coaxial rod-shaped articles and said draping step includes rolling the articles of the respective smokers' products about their axes to thereby convolute the corresponding uniting bands therearound.

4. The method of claim 2, wherein said applying step includes providing the one side of the web with two discrete layers of said aqueous dispersion.

5. The method of claim 4, wherein said web and said layers are of constant width and said applying step further includes leaving a portion of said one side of the web uncoated, said portion of said one side of the web being of constant width, being disposed between said layers and being substantially parallel to the marginal portions of the web.

6. The method of claim 1, wherein said wrapping material is a continuous web and said smokers' product is a continuous rod, and further comprising the step of transporting the web and the rod lengthwise, said heating step preceding said draping step.

7. The method of claim 6, wherein said applying step includes applying said layer to one marginal portion of said one side of the web.

8. The method of claim 1, further comprising the step of forcibly cooling the layer upon completion of said additional steps.

9. The method of claim 1, wherein said hotmelt is a copolymer of ethylene vinyl acetate.

10. The method of claim 1, wherein the thickness of said layer prior to said expelling step is between 10 and 15 micrometers.

11. The method of claim 10, wherein the thickness of said layer prior to said expelling step is approximately 12 micrometers and the thickness of said layer upon completion of said expelling step is approximately 6 micrometers.

12. The method of claim 1, wherein said wrapping material is selected from the group consisting of cigarette paper and imitation cork.

13. The method of claim 1, wherein at least one of said heating steps includes heating the layer by placing the other side of the wrapping material in direct contact with a hot surface.

14. The method of claim 1, wherein at least one of said heating steps includes exposing said layer to radiated heat.

15. In a machine for connecting a sheet-like wrapping material with rod-shaped smokers' products, the combination of a source of an aqueous dispersion of hotmelt; means for applying at least one layer of said dispersion to one side of the wrapping material; drying means for said layer, including a device for heating the layer to thereby expel the liquid therefrom; means for heating the dried layer at least to the melting point of the hotmelt; and means for draping the wrapping material with the dried layer around the smokers' products.

16. The combination of claim 15, wherein said wrapping material is a continuous web and further comprising means for transporting the web lengthwise past said applying and drying means.

17. The combination of claim 16, further comprising means for subdividing said web into a succession of discrete uniting bands, at least a portion of said heating means being located ahead of said draping means and said draping means including means for convoluting successive uniting bands around successive smokers' products.

18. The combination of claim 17, further comprising means for attaching successive uniting bands to the respective products, said convoluting means including means defining a gap for said products and for rolling successive products in said gap about their respective axes.

19. The combination of claim 16, wherein said applying means comprises means for providing said one side of the web with two discrete layers of said dispersion, said layers being adjacent to the marginal portions of said one side.

20. The combination of claim 16, further comprising means for perforating said web intermediate said drying and said heating means.

21. The combination of claim 16, wherein said applying means comprises means for providing said layer in the region of one marginal portion of said one side of the web.

22. The combination of claim 21, wherein said heating means is located ahead of said draping means.

23. The combination of claim 15, further comprising means for cooling the layer on the draped wrapping material.

24. The combination of claim 15, wherein said hotmelt is a copolymer of ethylene vinyl acetate.

* * * * *